US006016610A

United States Patent [19]

Sears

[11] Patent Number: 6,016,610

[45] Date of Patent: Jan. 25, 2000

[54] SELF-CLEANING LINT TRAP AND GRAVITY ASSISTED LINT TRAP

[75] Inventor: Jeffrey L. Sears, Grinnell, Iowa

[73] Assignee: Maytag Corporation, Newton, Iowa

[21] Appl. No.: 09/060,585

[22] Filed: Apr. 15, 1998

[51] Int. Cl.[7] ..... F26B 21/06

[52] U.S. Cl. ..... 34/82; 34/85; 34/604

[58] Field of Search ..... 34/312, 318, 326, 34/79, 82, 85, 88, 595, 603, 604, 609; 55/274, 295, 320, 332, 481, 509

[56] References Cited

U.S. PATENT DOCUMENTS 4,314,409 2/1982 Cartier et al. ..... 34/82
5,042,170 8/1991 Hauch et al. .
5,143,528 9/1992 Donglemans ..... 34/82 X
5,560,120 10/1996 Swanson et al. .
5,651,188 7/1997 Swanson et al. .
5,664,339 9/1997 Swanson et al. .
5,706,588 1/1998 Dausch et al. ..... 34/82 X

*Primary Examiner*—Stephen Gravini
*Attorney, Agent, or Firm*—Zarley, McKee, Thomte, Voorhees & Sease

[57] ABSTRACT

A self-cleaning lint trap includes an enclosed housing having an inlet port, an exhaust port, and a spiral chamber between the ports for imparting a circular air flow to air moving through the spiral chamber. A fine mesh screen extends across the exhaust port, and along the cylindrical side wall of the spiral chamber, for collecting lint from air passing through the chamber. A freely movable lightweight object is enclosed within the spiral chamber, and is moved about the chamber by the circular air flow to break off lint from the screens. A slot in the side wall of the chamber is fluidly connected to a lint collector, such that the compacted lint ball will be carried from the chamber through the slot and to the lint collector for later disposal.

20 Claims, 4 Drawing Sheets

SELF-CLEANING LINT TRAP AND GRAVITY ASSISTED LINT TRAP

BACKGROUND OF THE INVENTION

The present invention relates generally to lint filtration apparatus, and more particularly to a self-cleaning lint collection apparatus for a domestic dryer.

The conventional household dryer has many common features among the various manufacturers. One common feature, which is also a common problem, among household dryers is the lint collection system.

In general, the dryer will include a screen upon which lint is collected as exhaust air from the dryer exits the drying drum. The screen has a mesh size which collects lint as the exhaust air passes through the screen. Typically, the user must periodically remove the lint from the lint screen, in order to permit continuous efficient operation of the dryer. In many cases, this lint removal operation must be performed after every dryer cycle. Because this can become a tedious task, various attempts have been made to improve the lint collection system for domestic dryers.

While various attempts have been made to improve lint collection systems, they still suffer the same common problem. Namely, once the lint screen has become filled with lint, the screen must be manually removed and "unloaded" and returned to the dryer, to continue efficient operation of the dryer.

SUMMARY OF THE INVENTION

It is therefore a general object of the present invention to provide an improved lint filtration and collection apparatus which is self-cleaning.

Another object is to provide a self-cleaning lint trap which will automatically remove lint from a lint collection screen without requiring manual removal of the lint by the user.

A further object of the present invention is to provide a self-cleaning lint trap which is simple to use, and efficient in operation.

These and other objects of the present invention will be apparent to those skilled in the art.

The self-cleaning lint trap of the present invention includes an enclosed housing having an inlet port, an exhaust port, and a spiral chamber between the ports for imparting a circular air flow to air moving through the spiral chamber. A fine mesh screen extends across the exhaust port for collecting lint from air passing through the chamber. A freely movable lightweight object is enclosed within the spiral chamber, and is moved about the chamber by the circular air flow to break off lint from the screen as it accumulates. A slot in the side wall of the chamber is fluidly connected to a lint collection box, such that the pieces of removed lint will be carried from the chamber through the slot and to the collection box for later disposal.

In a preferred form of the invention, the housing includes a throat formed between the inlet port and the spiral chamber for directing air from the inlet port generally tangentially along the spiral chamber side wall. The lint collection box is connected via an exhaust tube to the slot in the spiral chamber side wall, and includes an operable drawer for receiving and collecting the lint from the spiral chamber. An exhaust port in the collection box is covered by a coarse mesh screen, to remove lint before exiting the collection box. The drawer is located beneath the exhaust port, to collect lint which drops by gravity from the coarse mesh screen.

The self-cleaning lint trap of the present invention may be installed in manufactured clothes dryers, eliminating the original lint trap therein, or may be marketed as an accessory item to provide enhanced filtration of lint, downstream of the blower in the exhaust line.

DESCRIPTION OF THE PREFERRED EMBODIMENT

Figure 1:
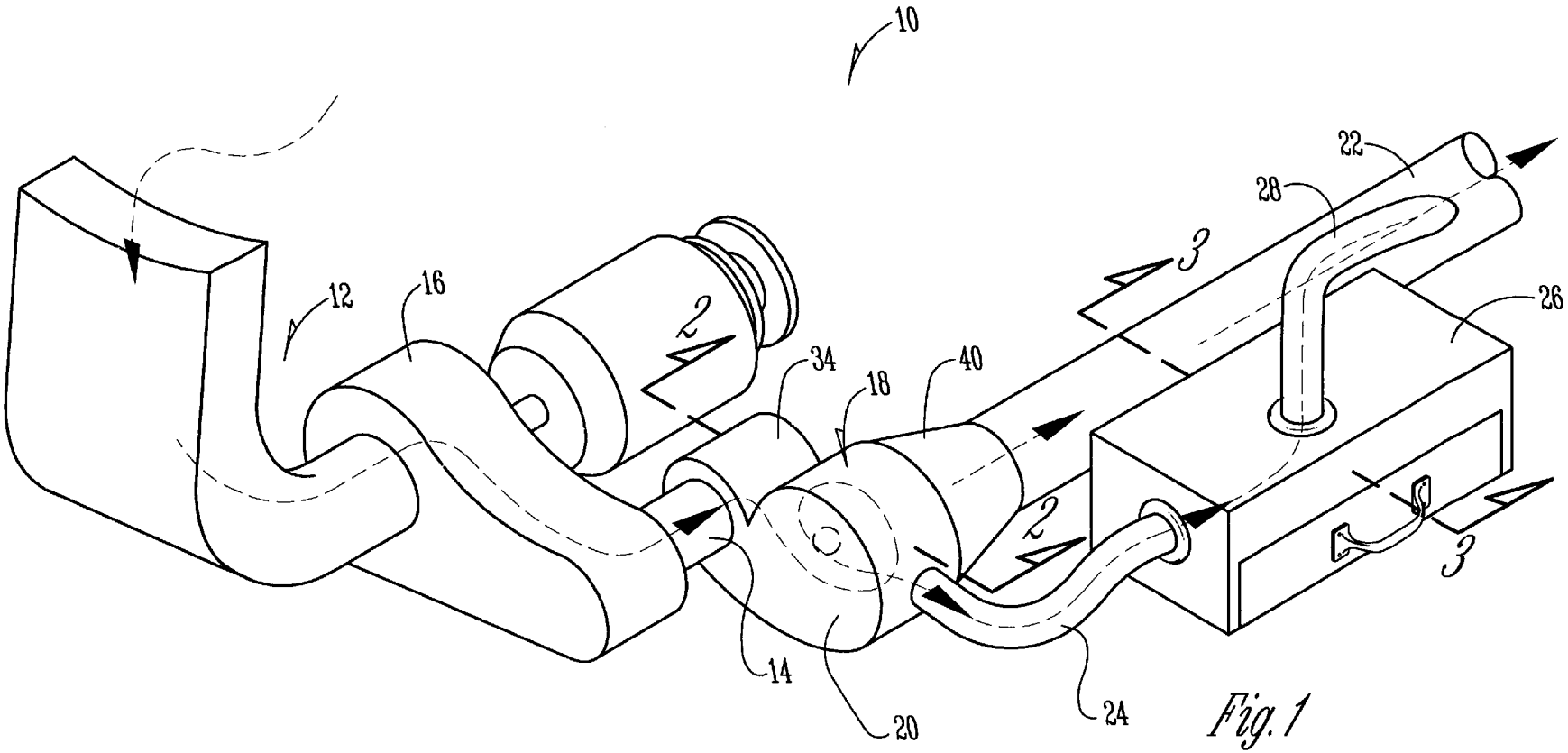
FIG. 1 is a perspective view of the lint collection apparatus of the present invention, removed from a dryer housing to show the components thereof.

Referring now to the drawings, in which similar or corresponding parts are identified with the same reference numeral, and more particularly to FIG. 1, the self-cleaning lint collection apparatus of the present invention is designated generally at 10 and connects to the conventional exhaust line 12 of a standard dryer, on the positive pressure outlet 14 of the blower 16.

Exhaust air from blower 16 flows into a cyclone housing 18 having a spiral or scroll shaped chamber 20 which will impart a circular motion to the air flow therein.

As can be seen in FIG. 1, cyclone housing 18 has two outlets: a large diameter exhaust pipe 22 and a lint exhaust tube 24. The exhaust pipe 22 exhausts the filtered air from the dryer directly to atmosphere. Lint exhaust tube 24 directs lint-entrained air through a collection box 26, for removal of collected lint from the air flow, and thence through an exhaust tube 28 to exhaust pipe 22 where it will then flow to the atmosphere. In the alternative, exhaust tube 28 could return the filtered air back to the inlet side of blower 16, for recirculation.

Figure 2:
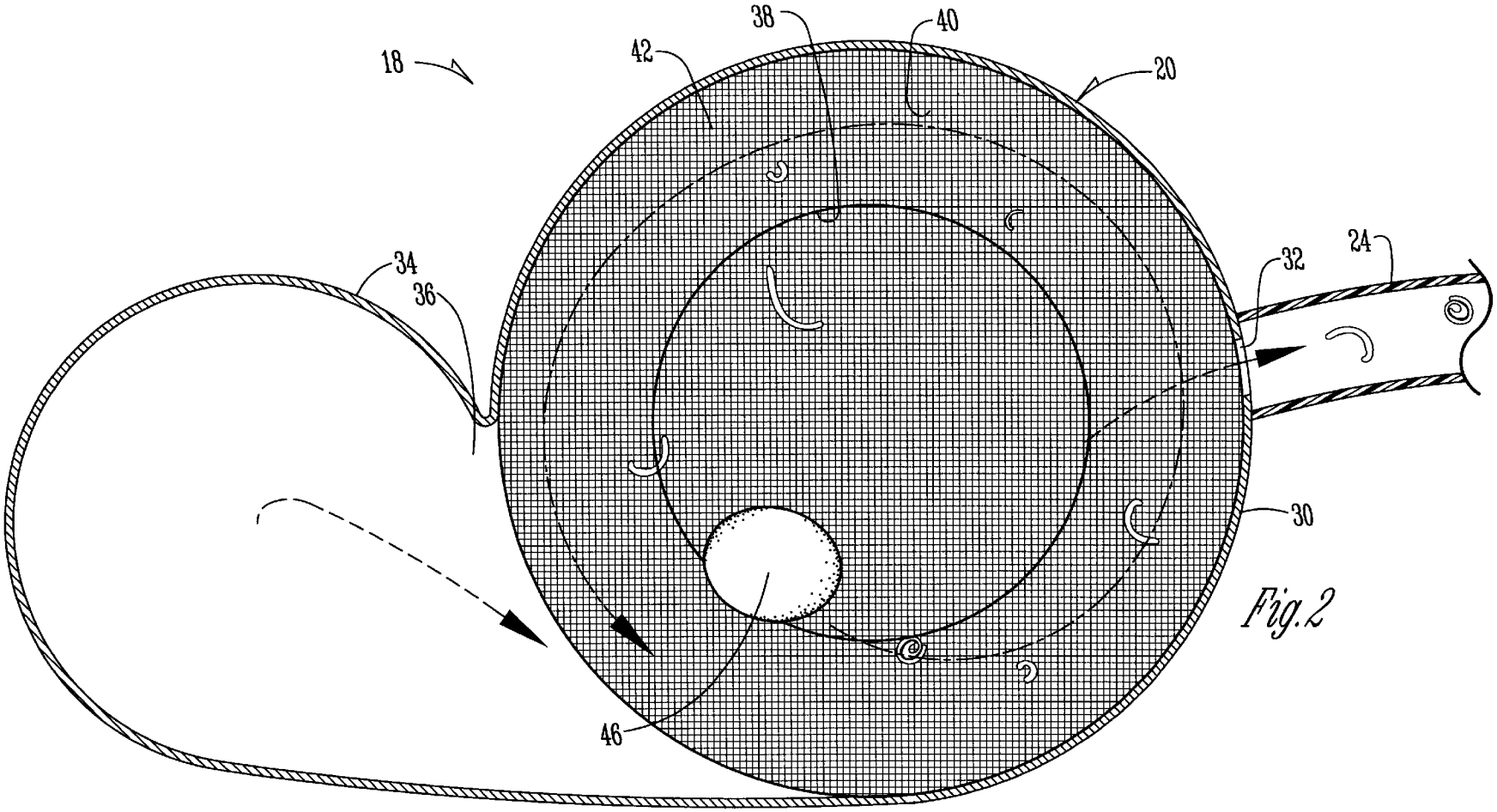
FIG. 2 is an enlarged sectional view taken at lines 2—2 in FIG. 1.

Referring now to FIG. 2, cyclone housing 18 is shown in more detail. Spiral chamber 20 of housing 18 includes a generally cylindrical side wall 30 with a slot 32 formed therein communicating with lint exhaust tube 24, for exhausting lint-entrained air from spiral chamber 20.

Housing 18 also includes a generally cylindrical inlet chamber 34 having an axis parallel to the axis of the spiral chamber 20. A throat 36 is formed between inlet chamber 34 and spiral chamber 20, and has a width less than the diameter of both inlet chamber 34 and spiral chamber 20. In this way, air flow from inlet chamber 34 into spiral chamber 20 is directed by the restricting opening size of throat 36 in a direction generally tangent to the side wall 30 of spiral chamber 20, and off center from the axis of spiral chamber 20. A large diameter exhaust port 38 is connected coaxially with the cylindrical axis of spiral chamber 20 such that air entering spiral chamber 20 from inlet chamber 34 is directed in a circular motion around the cylindrical side wall 30, before exiting through exhaust port 38 in rearward wall 40.

A fine mesh lint collection screen 42 extends across the entire generally circular surface of rearward wall 40 to remove lint from air passing through port 38.

A lightweight object 46 having a diameter greater than slot 32 is provided within spiral chamber 20, and will be blown around within the spiral chamber 20 by the circular air motion of air being exhausted through port 38. Object 46 will thereby knock lint from screen 42, and compact the lint into small pieces that will escape through slot 32.

The object 46 may be formed of any lightweight material, such as an open cell polyethylene foam, so long as its size is larger than slot 32, and light enough in weight to bounce about spiral chamber 20 by virtue of air flow through the chamber. Object 46 may be of any desired shape, and need not necessarily be spherical, as shown in the drawings.

Figure 3:
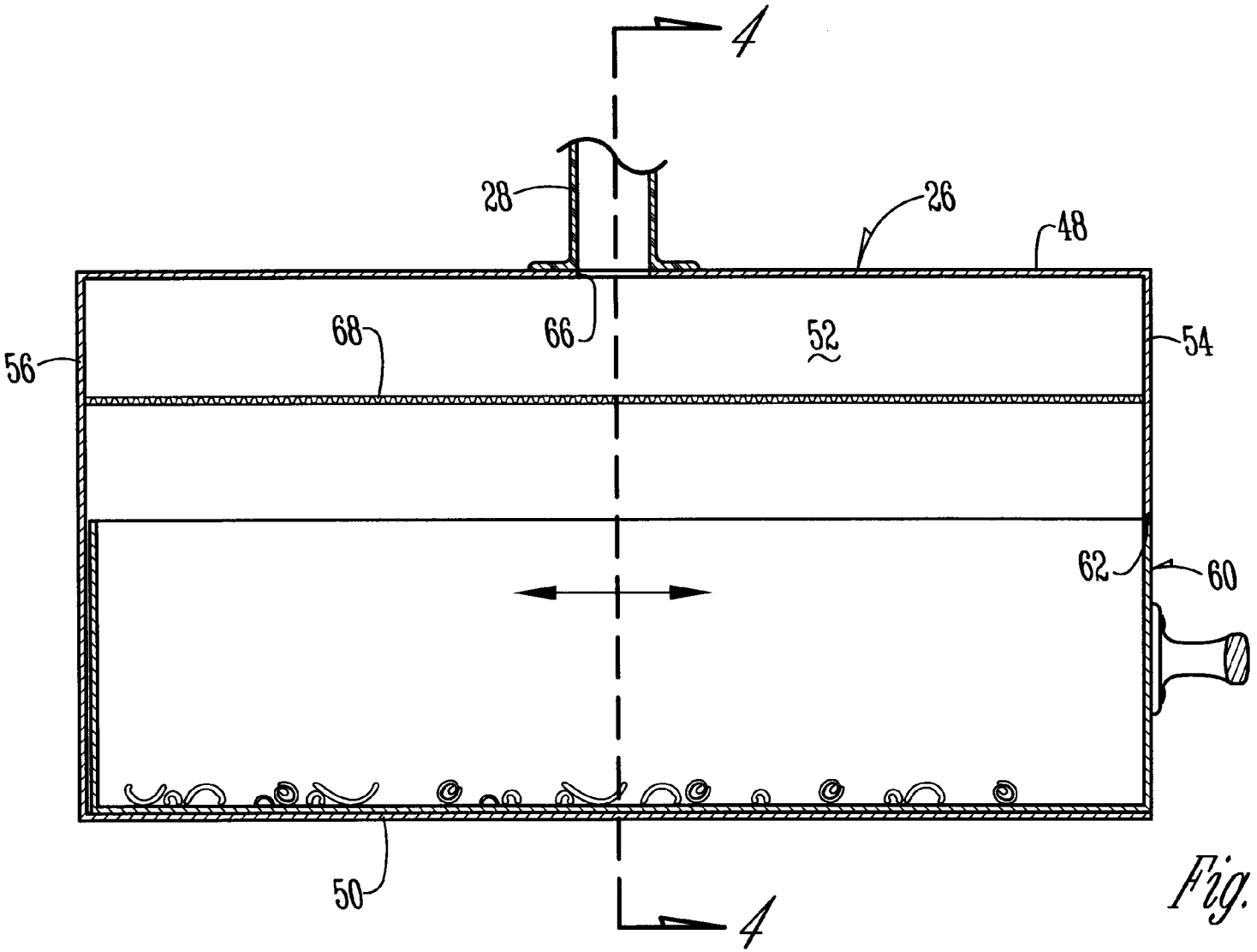
FIG. 3 is an enlarged sectional view taken at liens 3—3 in FIG. 1.
Figure 4:
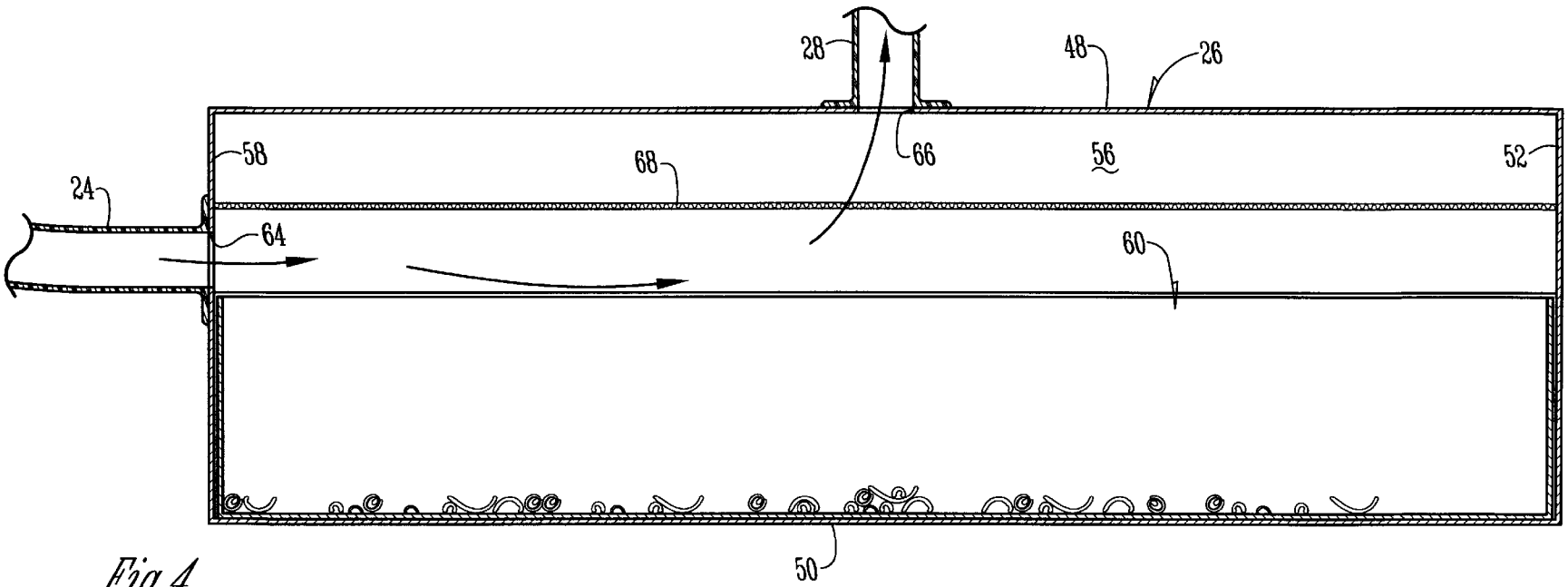
FIG. 4 is an enlarged sectional view taken at lines 4—4 in FIG. 3.

Referring now to FIGS. 3 and 4, lint-entrained air flows from the spiral chamber of cyclone housing 18 through lint exhaust tube 24 and into a lint collector such as the enclosed collection box 26. Collection box 26 includes upper and lower walls 48 and 50, respectively, and four side walls 52, 54, 56, and 58. A drawer 60 is slidably supported within box 26 on lower wall 50, and may be removed through an opening 62 in side wall 54, in a conventional fashion.

As shown in FIG. 4, lint exhaust tube 24 communicates with box 26 through an aperture 64 in side wall 58. Aperture 64 is located above drawer 60, so that lint pieces and balls entrained within the air flow, will drop by gravity into drawer 60 for later removal. An exhaust port 66 is formed in upper wall 48 of box 26. Coarse mesh screen 68 extends across drawer 60 and will prevent lint balls from leaving box 26, without severely retarding air flow through exhaust tube 28.

In operation, exhaust air from the dryer will bypass the conventional lint screen in the dryer, and lint will be deposited on screen 42 in spiral chamber 20 as the exhaust air passes therethrough. The object 46 will bounce around within spiral chamber 20, knocking lint from the lint screen 42, thereby breaking the lint into pieces which are carried from spiral chamber 20. It has been found that a fine mesh screen having openings of approximately 250 microns, is effective to collect the lint from the air flow. The lint pieces are then carried through slot 32 in lint exhaust tube 24 to collection box 26, where they are collected by gravity in drawer 60. While intake aperture 64 is shown in side wall 58, and exhaust port 66 is shown in upper wall 48, it should be noted that aperture 64 in port 66 may be located at any desired location on box 26, so long as they are located above drawer 60, so that gravity will cause the lint balls to collect within the drawer. The coarse mesh screen 68 preferably has openings of approximately 1,000 microns, which are sufficiently large to remove lint balls, without slowing air flow exiting box 26.

Because of the size of drawer 60, and the fact that lint is compacted into lint balls, it is only necessary to empty the drawer of lint after several cycles of dryer operation. In addition, it is not necessary for the user to physically contact the lint during the removal operation.

Whereas the invention has been shown and described in connection with the preferred embodiment thereof, many modifications, substitutions and additions may be made which are within the intended broad scope of the appended claims.

I claim:

1. A self-cleaning lint filtration apparatus, comprising:

an enclosed housing having an inlet port, an exhaust port, and a spiral chamber between the ports for imparting a circular air flow to lint-entrained air moving from the inlet port to the exhaust port;

said spiral chamber having a perimeter side wall;

a screen extending across the exhaust port, for collecting lint from air passing therethrough;

a slot formed in the side wall, for exhausting lint from the housing;

an object having a size greater than the slot, freely movable within the spiral chamber, having a shape and weight such that air flow through the spiral chamber will cause the object to continuously bounce about; and a lint collector in fluid communication with the slot, for receiving and collecting lint.

2. The apparatus of claim 1, wherein the perimeter side wall is generally cylindrical.

3. The apparatus of claim 2, further comprising a throat formed within the housing for directing air from the inlet port generally tangentially along the spiral chamber side wall.

4. The apparatus of claim 3, wherein said lint collector includes a collection box having an inlet aperture fluidly connected to the housing slot, an exhaust port for exhausting air from the box, and a coarse mesh screen between the inlet aperture and the exhaust port, for removing lint from air exhausted through the box exhaust port.

5. The apparatus of claim 4, wherein said lint collection box includes an open topped drawer operably mounted within the box for selective removal therefrom.

6. The apparatus of claim 5, wherein said drawer is located in a lower portion of the box, and wherein the inlet aperture and box exhaust port are located in an upper portion of the box above the drawer.

7. The apparatus of claim 1, further comprising a throat formed within the housing for directing air flow from the inlet port generally longitudinally along the spiral chamber side wall.

8. The apparatus of claim 1, wherein said lint collector includes a collection box having an inlet aperture fluidly connected to the housing slot, an exhaust port for exhausting air from the box, and a coarse mesh screen between the inlet aperture and the exhaust port, for removing lint form air exhausted through the box exhaust port.

9. The apparatus of claim 8, wherein said lint collection box includes an open topped drawer operably mounted within the box for selective removal therefrom.

10. A self-cleaning lint filtration apparatus for a laundry dryer of the type having a dryer drum with an air exhaust line for exhausting lint-entrained air from the drum, and a blower having an inlet connected to the exhaust line and an outlet for creating an air flow through the drum, the exhaust line and out the blower outlet, comprising:

an enclosed housing having an inlet port connected to the blower outlet, an exhaust port, and a spiral chamber between the ports for imparting a circular air flow to air moving from the inlet port to the exhaust port;

said spiral chamber having a perimeter side wall;

a screen extending across the exhaust port, for collecting lint form air passing therethrough;

a slot formed in the side wall, for exhausting lint from the housing;

an object having a size greater than the slot, freely movable within the spiral chamber, having a shape and weight such that air flow through the spiral chamber will cause the object to continuously bounce about; and a lint collector in fluid communication with the slot, for receiving and collecting lint.

11. The apparatus of claim 10, wherein the perimeter side wall is generally cylindrical.

12. The apparatus of claim 10, further comprising a throat formed within the housing for directing air flow from the inlet port generally longitudinally along the spiral chamber side wall.

13. The apparatus of claim 10, wherein said lint collector includes a collection box having an inlet aperture fluidly connected to the housing slot, an exhaust port for exhausting air form the box, and a coarse mesh screen between the inlet aperture and the exhaust port, for removing lint from air exhausted through the box exhaust port.

14. The apparatus of claim 13, wherein said lint collector includes an open topped drawer operably mounted within the box for selective removal therefrom.

15. The apparatus of claim 14, wherein said drawer is located in a lower portion of the box, and wherein the inlet aperture and box exhaust port are located in an upper portion of the box above the drawer.

16. In combination:

a laundry dryer exhaust line having a blower with an inlet connected to a dryer drum exhaust vent and outlet, the blower creating an air flow from the exhaust vent, through the blower inlet, and out the blower outlet; and a self-cleaning lint filtration apparatus connected to the blower outlet, said self-cleaning lint filtration apparatus including:

an enclosed housing having an inlet port connected to the blower outlet, an exhaust port, and a spiral chamber between the ports for imparting a circular air flow to air moving from the inlet port to the exhaust port;

said spiral chamber having a perimeter side wall;

a screen extending across the exhaust port, for collecting lint from air passing therethrough;

a slot formed in the side wall, for exhausting lint from the housing;

an object having a size greater than the slot, freely movable within the spiral chamber, having a shape and weight such that air flow through the spiral chamber will cause the object to continuously bounce about; and a lint collector in fluid communication with the slot, for receiving and collecting lint.

17. The combination of claim 16, wherein the perimeter side wall is generally cylindrical.

18. The combination of claim 16, further comprising a throat formed within the housing for directing air flow from the inlet port generally longitudinally along the spiral chamber side wall.

19. The combination of claim 16, wherein said lint collector includes a collection box having an inlet aperture fluidly connected to the housing slot, an exhaust port for exhausting air form the box, and a coarse mesh screen between the inlet aperture and the exhaust port, for removing lint from air exhausted through the box exhaust port.

20. The combination of claim 19, wherein said lint collection box includes an open topped drawer operably mounted within the box for selective removal therefrom.

* * * * *